United States Patent [19]

Jansen

[11] 4,361,325

[45] Nov. 30, 1982

[54] HOCKEY STICK SHAFT

[75] Inventor: T. Paul Jansen, Clarence, N.Y.

[73] Assignee: Brimms Inc., Tonawanda, N.Y.

[21] Appl. No.: 250,559

[22] Filed: Apr. 3, 1981

[51] Int. Cl.[3] ..... A63B 59/14; A63B 59/12

[52] U.S. Cl. ..... 273/67 A; 273/326; 273/DIG. 2

[58] Field of Search ..... 273/67 R, 67 A, 73 R, 273/73 C, 73 F, 73 H, 80 R, 80 B, 81.4, 326, DIG. 2

[56] References Cited

U.S. PATENT DOCUMENTS

| | | | |
|---|---|---|---|
| 3,489,412 | 1/1970 | Franck et al. | 273/67 A |
| 3,561,760 | 2/1971 | Klay | 273/67 A |
| 3,934,875 | 1/1976 | Easton et al. | 273/67 A |
| 3,971,094 | 7/1976 | Solf et al. | 273/81.4 X |
| 3,982,760 | 9/1976 | Tiitola | 273/67 A |
| 4,192,505 | 3/1980 | Tabickman | 273/73 C |

FOREIGN PATENT DOCUMENTS

| | | | |
|---|---|---|---|
| 918697 | 1/1973 | Canada | 273/67 A |
| 922750 | 3/1973 | Canada . | |
| 30050 | of 1912 | United Kingdom | 273/80.7 |

*Primary Examiner*—Anton O. Oeschsle

*Attorney, Agent, or Firm*—Christel, Bean & Linihan

[57] ABSTRACT

An elongated, hollow, game stick handle for hockey sticks, or the like, and formed from a plastic material, the handle having a substantially rectangular cross-section. The outer and inner surfaces are arcuately shaped for increased strength and improved fracture resistance. The side walls and corners are of non-uniform thickness and the minimum wall thickness of the shorter sides is greater than the minimum wall thickness of the larger sides, while the maximum wall thickness of the corners is greater than the minimum wall thicknesses of the shorter or larger sides.

3 Claims, 3 Drawing Figures

HOCKEY STICK SHAFT

BACKGROUND OF THE INVENTION

The present invention relates to game sticks, and more particularly to an improved hollow handle or shaft for hockey sticks used in street hockey, ice hockey, and the like, and which has greater resistance to breaking and cracking than prior art shafts. Hollow shafts of this type may also be used, for example, as exercise wands, lacrosse stick handles, and curling broom handles.

It is well known that hockey sticks are subjected to a variety of stresses during the course of a hockey game, and that it is desirable that the sticks be both durable and flexible to avoid permanent deformation and breakage due to impact. Along this line, it has been suggested that hockey sticks having hollow shafts or handles and made from synthetic materials have desirable durability and flexibility. For example, U.S. Pat. 3,961,790 shows a hollow hockey stick shaft of synthetic material and having a rectangular cross-section in conjunction with a non-integral blade for improved fracture resistance over conventional wooden hockey stick shafts. U.S. Pat. 4,086,115 discloses a hollow, resin impregnated fiberglass shaft of rectangular cross-section using Kevlar rovings or carbon-graphite type fibers for reinforcement and determination of the flexibility of the shaft. In addition, Canadian Pat. No. 918,697 shows a plastic hockey stick having a substantially pyramidally shaped hollow in its shaft providing greater mass at the blade end of the shaft for shock resistance.

Customarily, hockey players prefer hockey stick shafts having substantially rectangular cross-sections. Such a shaft affords the user a comfortable grip in addition to providing him with greater awareness of and control over the orientation of the blade during play, as compared with, for instance, a shaft having a circular or square cross-section. It has been discovered that hockey sticks having hollow shafts of synthetic material with rectangular cross-sections defined by a pair of identical, parallel, planar broad sides connected by a pair of identical, parallel, planar narrow sides, the broad sides and narrow sides having generally the same wall thickness, tend to crack or break when subjected to the normal forces generated during the course of play. This cracking or breaking generally occurs in a corner of the shaft where one broad side meets one narrow side, or in the wall of a narrow side, where stresses are most concentrated.

In order to make such hockey stick shafts more durable it has been found necessary to increase the wall thickness of the sides of the shaft or to provide reinforcing ribs in the interior of the shaft. While this increases the strength of the shaft, it also increases the weight of the shaft and decreases its flexibility. In addition, the increase of material in the shaft renders it more costly.

SUMMARY OF THE INVENTION

Accordingly, an object of this invention is to provide a new and improved hollow hockey stick shaft, preferably of extruded plastic construction, having arcuately formed side walls and corner portions of varying thicknesses providing strength, impact resistance and flexibility to the shaft while requiring a minimal amount of material for construction thereof and maintaining a peripheral configuration conforming generally to that preferred by hockey stick users.

The present invention thus provides a hollow, elongated game stick handle having pairs of opposed sides having arcuate outer faces and interconnected by rounded corner portions to define a substantially rectangular cross-section. The sides and corner portions have variable wall thicknesses, the minimum wall thickness of one pair of opposed sides being greater than the minimum wall thickness of a second pair of opposed sides, and the maximum wall thickness of the corner portions being greater than the minimum thicknesses of each of the first and second sides.

DETAILED DESCRIPTION OF AN ILLUSTRATIVE EMBODIMENT

Figure 1:
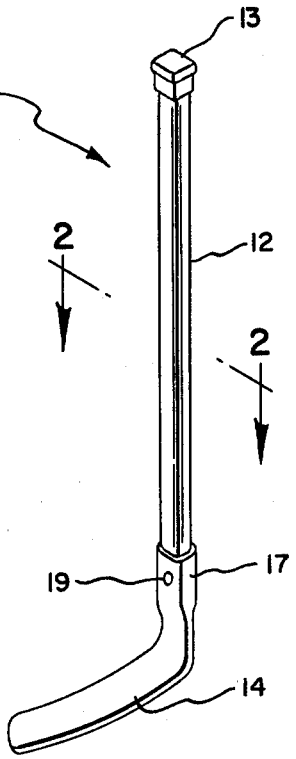
FIG. 1 is a perspective view of a hockey stick having a shaft according to the present invention.

Referring now to the drawing, there is shown in FIG. 1 a hockey stick 10 comprising an elongated, hollow shaft or handle 12 according to the present invention and having a conventional plastic blade 14 secured at one end thereof and a plastic cap or grip 13 secured at the opposite end. The one end of shaft 12 can be press fit or otherwise inserted into the shaft receiving collar 17 of blade 14 and may be further secured thereto by a bolt 19 or other suitable fastening means. Cap 13 may be fitted over the opposite end of shaft 12 and fastened thereto by any suitable fastening means.

Shaft 12 is straight, and can be of any length to suit a variety of player sizes, from small children to large adults. It is preferably an extrusion of a synthetic plastic material having the requisite strength, rigidity, and formability, such as an ABS (acrylonitrile-butadiene-stryrene) extrusion grade resin, but it may be manufactured from any natural or synthetic material, or combination thereof, suitable for use as a hockey stick shaft and capable of being worked, molded, extruded or otherwise being made to conform to the configuration that is to be presently described in detail, and having the necessary strength and toughness to resist breaking or cracking in use.

Figure 2:
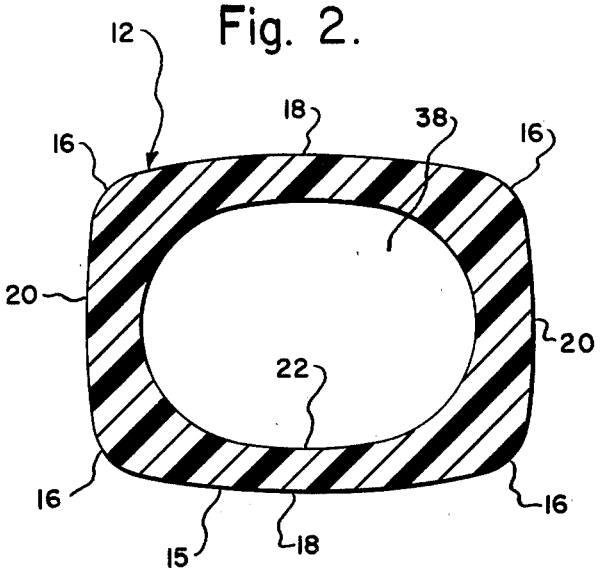
FIG. 2 is a cross-sectional view of the hockey stick shaft according to the present invention taken along line 2—2 of FIG. 1.

As shown in the cross-sectional view of FIG. 2, shaft 12 has a generally rectangular cross-section defined by a pair of opposed, non-planar broad side walls 18 interconnected with a pair of opposed, non-planar narrow side walls 20, the interconnection being made by four rounded corner portions 16. The interior of shaft 12 is hollow, with oblongated interior surface 22 defining a hollow 38.

Figure 3:
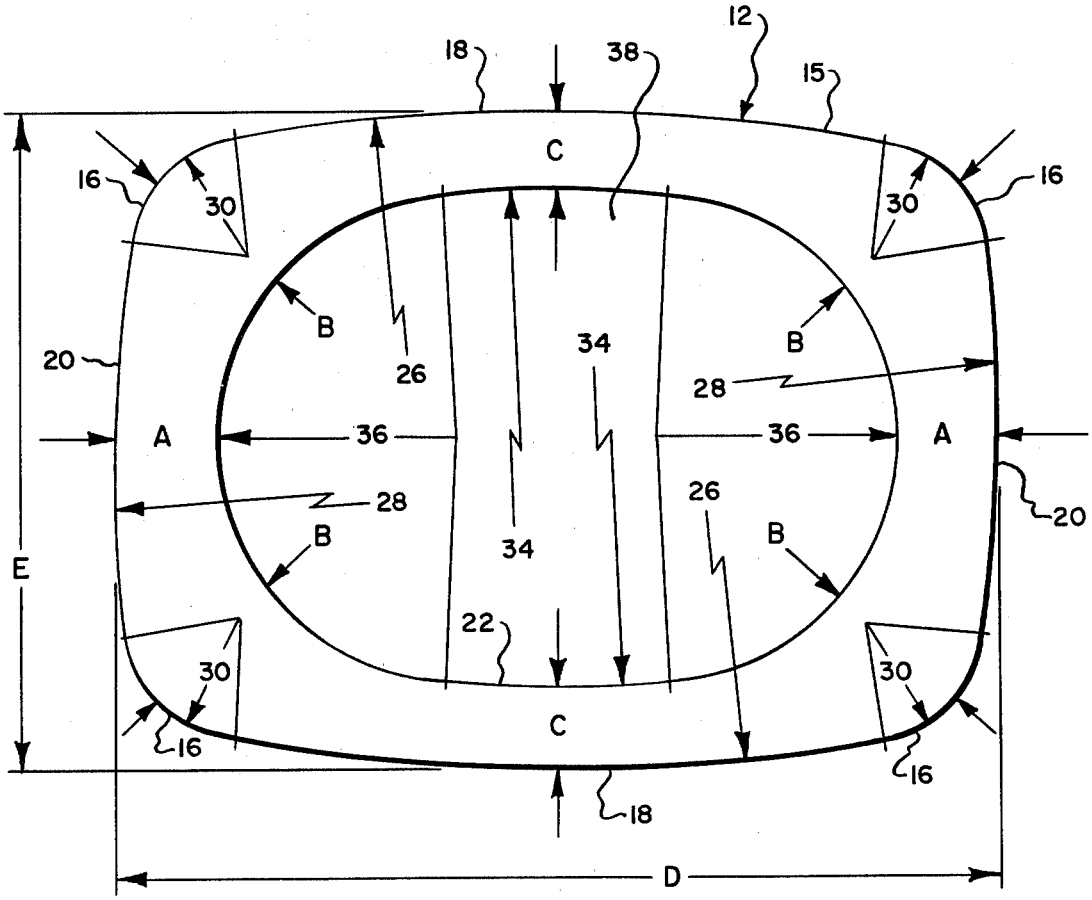
FIG. 3 is an enlarged cross-sectional view of the hockey stick shaft according to the present invention wherein the several dimensional factors are identified.

The details of the various dimensional aspects of the structure of the hockey stick shaft of the present invention are shown more clearly in FIG. 3. The thickness of broad side walls 18 is non-uniform. Each side wall 18 is thinnest at substantially its midpoint C and increases in thickness substantially symmetrically on opposite sides of the midpoint, the maximum thicknesses of the side wall occurring where it blends into adjacent corner portions 16. Likewise, the thickness of narrow side walls 20 is non-uniform. Each side wall 20 is thinnest at substantially its midpoint A and increases in thickness substantially symmetrically on opposite sides of the midpoint, the maximum thicknesses of the side wall occurring where it blends into adjacent corner portions. The minimum thickness of the narrow side walls 20 is greater than the minimum thickness of the broad side walls 18, and the thickness at B at the corner portions 16 is greater than the minimum thicknesses of the several side walls. The non-uniform thicknesses of the side walls 18, 20 and the corner portions 16 remain substantially the same throughout the entire length of the shaft.

The various thicknesses of side walls 18, 20 and corner portions 16 derive from the particular combination of circular arcs defining the exterior surface 15 of the cross-section of shaft 12, as shown in FIGS. 2 and 3, and those defining the interior surface 22. Exterior surface 15 is defined by a continuous series of connected circular arcs 26, 28, 30. Arcs 26 define the exterior surface of broad side walls 18, arcs 28 define the exterior surface of narrow side walls 20 and arcs 30 define the exterior surface of corner portions 16. Side walls 18, 20 thus have convex exterior surfaces connected by convex corner portions 16. Interior surface 22 is defined by a continuous series of connected arcs 34, 36 which also define hollow 38.

The radius of curvature of the aforementioned arcs can be any of a number of values to provide the desired generally rectangular periphery as well as the desired relative wall thicknesses. For example, for a hockey stick having a major outer dimension D of 1.1550 inches and a minor outer dimension E of 0.8625 inches which provides a ratio of D to E of 1.339, it has been found that a suitable radius of curvature for the aforementioned arcs is as follows:

Arcs 26—3.7071 inches
Arcs 28—2.5018 inches
Arcs 30—0.150 inches
Arcs 34—3.5971 inches
Arcs 36—0.32125 inches As shown in FIGS. 2 and 3, due to the relative arc sizes defining the interior and exterior surfaces 22 and 15, respectively, the thickness of broad side walls 18 increases more gradually than the thickness of narrow side walls 20 as the walls approach the respective adjacent corner portions from opposite sides of their respective intermediate points C and A. The thickness of the intermediate points C and A is dependent upon the radius of curvature of the arcs defining the interior and exterior surfaces 22 and 15. An example of suitable intermediate point thicknesses is 0.110 inches for broad side walls 18 and 0.125 inches for narrow side walls 20. It will be recognized that the maximum thickness at the corner portions 16 is significantly greater than the minimum thickness of either broad side walls 18 or narrow side walls 20.

From the foregoing description, it can be seen that interior and exterior surfaces 22 and 15 are each nonplanar, yet shaft 12 has a substantially rectangular cross-section. Thus, the shaft configuration most preferred by hockey players in general is substantially maintained. In addition, it has been determined that a hockey stick shaft embodying the cross-sectional configuration disclosed herein more effectively distributes stresses within the shaft occurring, for example, as a result of impacts during play. This results in improved resistance to cracking and breaking and not only prolongs the life of the shaft, but also decreases the probability of personal injury resulting from the fracture or splintering of a shaft. An ABS hockey stick shaft having such a configuration also possesses the desired rigidity for strength and durability.

While a preferred embodiment of the invention has been illustrated and described, it will be understood that such description and illustration is by way of example only and such modifications and changes as may suggest themselves to those skilled in the art are intended to fall within the scope of the present invention as is limited only by the appended claims.

I claim:

1. A hollow, elongated handle for game sticks or the like, said handle having a uniform cross-sectional configuration substantially throughout its length, said cross-sectional configuration comprising a pair of opposed first walls having convex outer faces and a pair of opposed second walls having convex outer faces, said first walls being longer than said second walls, the outer faces of said first walls and said second walls being interconnected by rounded corner portions to define a substantially rectangular cross-section, said handle having an arcuate inner surface defining a hollow area, said first and said second walls and said corner portions having varying wall thicknesses defined by the exterior surface of said cross-section and said inner surface, the minimum wall thickness of said second walls being greater than the minimum wall thickness of said first walls, and the maximum wall thickness of said corner portions being greater than the minimum wall thicknesses of each of said first walls and of said second walls.

2. The handle of claim 1 wherein said convex outer faces of said first and second walls are defined by circular arcs, the radius of curvature of the circular arcs defining the convex outer faces of said first walls being greater than the radius of curvature of the circular arcs defining the convex outer faces of said second walls.

3. The handle of claim 1 wherein said arcuate inner surface is defined by a series of connected circular arcs.

* * * * *